United States Patent [19]

Terakami

[11] 4,309,584

[45] Jan. 5, 1982

[54] MATRIX KEYBOARD FOR SELECTION OF FOODSTUFF AND ITS ASSOCIATED COOKING PROGRAM

[75] Inventor: Yukio Terakami, Nara, Japan

[73] Assignee: Sharp Kabushiki Kaisha, Osaka, Japan

[21] Appl. No.: 78,895

[22] Filed: Sep. 25, 1979

[30] Foreign Application Priority Data

Sep. 25, 1978 [JP] Japan ..... 53/118152

[51] Int. Cl.[3] ..... H05B 6/66

[52] U.S. Cl. ..... 219/10.55 B; 219/10.55 R; 219/492; 219/506; 99/342; 236/46 D

[58] Field of Search ..... 219/10.55 R, 10.55 B, 219/506, 492, 497; 99/325, 342; 236/46 D

[56] References Cited

U.S. PATENT DOCUMENTS

| | | | |
|---|---|---|---|
| 3,846,607 | 11/1974 | Bucksbaum | 219/10.55 B |
| 3,932,723 | 1/1976 | Tamano et al. | 219/10.55 B |
| 3,979,056 | 9/1976 | Barnes . | |
| 4,121,204 | 10/1978 | Welch et al. . | |
| 4,213,562 | 7/1980 | Garrett et al. | 219/492 |

FOREIGN PATENT DOCUMENTS

| | | | |
|---|---|---|---|
| 52-38657 | 3/1977 | Japan | 219/10.55 B |

OTHER PUBLICATIONS

*Electronics;* vol. 49, No. 25, pp. 105–110, 12/9/76; "Single-Chip Microprocessor Rules the Roast" by B. Bell and D. Ogden.

*Primary Examiner*—Gene Z. Rubinson
*Assistant Examiner*—Keith E. George
*Attorney, Agent, or Firm*—Birch, Stewart, Kolasch & Birch

[57] ABSTRACT

A cooking utensil comprises a matrix type keyboard operable for generating cooking program sequences for controlling energization of a heat source. A plurality of key switches are disposed within the matrix keyboard in which an abscissa represents temperature values and an ordinate represents time periods both of which are information for the cooking program sequences. Each of the plurality of key switches is operable for directing the cooking of a kind of a specific foodstuff and for reading out the associated cooking program sequences according to which the heat source is energized to produce the specific foodstuff from starting materials therefor. In a specific form, the cooking utensil can be a combination of a microwave oven and one or more other heat-source apparatus.

17 Claims, 5 Drawing Figures

MATRIX KEYBOARD FOR SELECTION OF FOODSTUFF AND ITS ASSOCIATED COOKING PROGRAM

BACKGROUND OF THE INVENTION

The present invention relates in general to a cooking utensil and, more particularly, to a cooking utensil comprising means for selecting one of a plurality of cooking items and its associated cooking program information.

Recently, in a cooking utensil such as a microwave oven, an electric heating oven and the like, it has become easier to conduct desired cooking program sequences with the aid of a micro-computer control as disclosed in, say, Fosnough et al, U.S. Pat. No. 4,011,428 issued Mar. 8, 1977, entitled "MICROWAVE OVEN TIMER AND CONTROL CIRCUIT".

However, the micro-computer controlled microwave oven as mentioned in U.S. Pat. No. 4,011,428 has still some defects in that the respective cooking program sequences to be conducted should be each introduced into a control circuit by actuating numeral keys with references to a cooking book or the like.

The respective cooking program sequences are defined by heating time periods and power information for a heating source.

Presently, combination cooking appliances meet with public approval. An example of these combination cooking appliance includes a microwave oven and a different heating source oven such as an electric heating oven. In such a combination cooking appliance, however, it is rather complex to introduce the respective cooking program sequences including the heating time periods and the power information to be used because at least two heating sources are being controlled.

The thus stored cooking program sequences are effected in the cooking appliance upon actuation of a start switch.

On the other hand, another type of a microwave oven with programming and control means was proposed for automatically controlling the sequences and durations of application of microwave energy and thermal energy to foodstuffs in the oven, for example, White et al, U.S. Pat. No. 3,569,656 issued Mar. 9, 1979, entitled "AUTOMATIC COOKING CYCLE CONTROL SYSTEM FOR MICROWAVE OVENS".

The desired sequences and durations in this U.S. Patent can be introduced into a control network therein by actuating a respective one of a number of pushbuttons each for a particular cooking operation as "warm, "bake", "roast", "crisp" and broil".

However, the particular cooking operation has no concern with the kind of cooking which corresponds to the kind of the foodstuffs to be cooked, for example, roast beef, poundcake and so on.

Therefore, it is greatly desired that a unique cooking appliance, in particular, a combination cooking oven be capable of developing the desired cooking program sequences which are preliminarily stored therein in response to manual actuations of keys, the cooking program sequences corresponding to the kind of the foodstuffs used.

SUMMARY OF THE INVENTION

Accordingly, it is the primary object of the present invention to provide an improved cooking apparatus with the facilities for allowing simple instruction of cooking program sequences.

It is a further object of the present invention to provide an improved cooking apparatus for storing cooking program instruction sequences in connection with the kind of foodstuffs to be cooked.

It is a further object of the present invention to provide an improved combination cooking utensil, say, a combination microwave oven and one or more different heat-source ovens, including facilities for storing cooking program instruction sequences in connection with the kind of foodstuffs to be cooked.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

To obtain the above objectives, pursuant to an embodiment of the present invention, a cooking utensil comprises a matrix type keyboard operable for generating cooking program sequences for controlling energization of a heat source. A plurality of key switches are disposed within the matrix keyboard in which an abscissa represents temperature values and an ordinate represents time periods both of which are information for the cooking program sequences. Each of the plurality of key switches is operable for directing the kind of a specific foodstuff and for reading out the associated cooking program sequences in accordance to which heat source is energized to produce the specific final foodstuff product from starting materials therefor. In a specific form, the cooking utensil can be a combination of a microwave oven and one or more other heat-source apparatus.

BRIEF DESCRIPTION OF THE DRAWINGS

The present invention will become more fully understood from the detailed description given hereinbelow and accompanying drawings which are given by way of illustration only, and thus are not limitative to the present invention and wherein.

DESCRIPTION OF THE INVENTION

The application of the present invention is not limited to a combination of a microwave oven and an electric heating oven although so indicated throughout the drawings. The present control panel assembly can be readily applied to any cooking utensil such as a single microwave oven, an electric heating oven, a gas oven, and any combination of a microwave oven and one or more different heat-source oven. The type of application will be within the knowledge of one having ordinary skill in the art. For convenience of description, the present invention will be described hereinafter with reference to a combination of a microwave oven and an electric heating oven.

Figure 1:
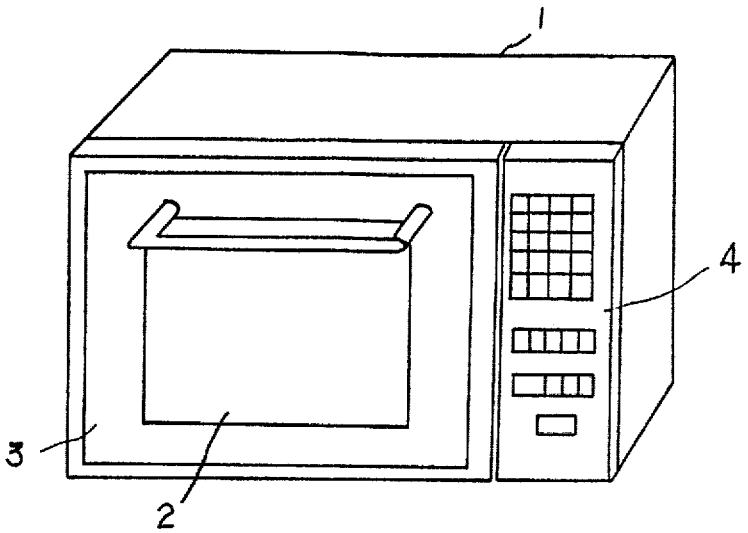
FIG. 1 is a perspective view of a combination of a microwave oven and an electric oven according to the present invention.

FIG. 1 shows a combination cooking utensil 1 incorporating a microwave oven and an electric heating oven according to the present invention. With reference to FIG. 1, the combination cooking utensil 1 contains an oven cavity 2, a door 3, and a control panel 4 carrying a keyboard.

Figure 2:
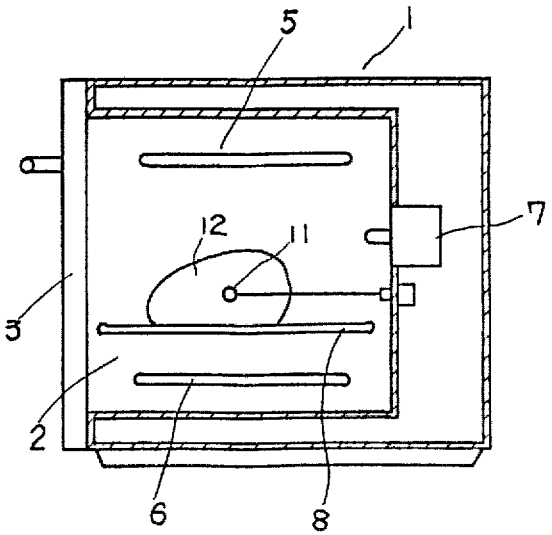
FIG. 2 is a cross sectional view of the combination oven shown in FIG. 1.

FIG. 2 diagrammatically represents the inner parts of the combination cooking utensil 1 in a cross sectional view. Referring to FIG. 2, there are provided within the combination cooking utensil 1, an upper heater 5, a lower heater 6, a magnetron 7, a tray or net 8, a temperature monitoring element or a thermistor 11, and a foodstuff 12.

The upper heater 5 is provided for causing electric heating mode in conjunction with the lower heater 6. The tray or net 8 carrying the foodstuff 12 is placed between the upper and lower heaters 5 and 6. The thermistor 11 is employed to monitor the inner temperature of the foodstuff 12 by installation within the latter.

Figure 3:
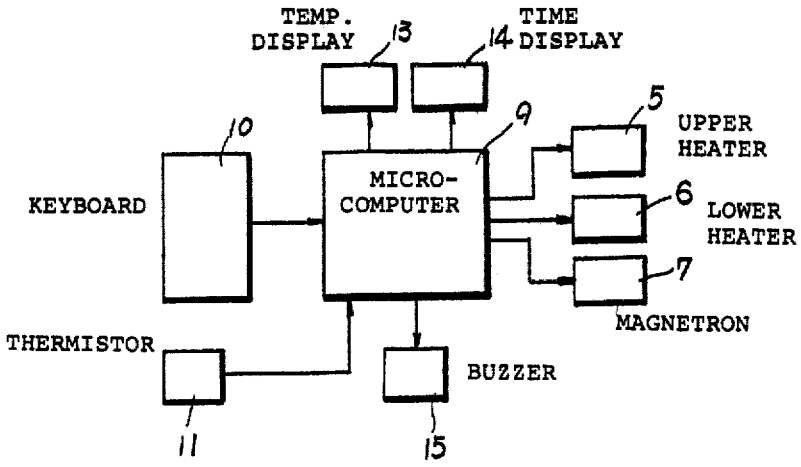
FIG. 3 is a block diagram of a control circuit incorporated within the combination oven of FIG. 1.

FIG. 3 shows a block diagram of a control circuit incorporated within the combination cooking utensil 1. The control circuit comprises a microcomputer 9, a keyboard 10, a temperature display 13, a time display 14, a buzzer 15, the upper heater 5, the lower heater 6, the thermistor 11, and the magnetron 7.

The keyboard 10 is mounted on the control panel 4. The microcomputer 9 includes a storage area such as read only memory (ROM). Cooking program sequences are delivered from the storage area in accordance with actuation of keys contained within the keyboard 10. According to the thus delivered cooking program sequences, each of the upper heater 5, the lower heater 6, and the magnetron 7 is energized for the associated heating mode. The inner temperature detected by the thermistor 11 is transferred to the microcomputer 9 in the form of a resistance value.

The microcomputer 9 activates the temperature display 13 and the time display 14 so that they indicate preset values, respectively. The preset value for the temperature display 13 is related to a temperature to which the foodstuff 12 is heated. Another preset value for the time display 14 is concerned with a time period during which the foodstuff 12 is cooked. The buzzer 15 is energized for alarm indication when the given cooking program sequences are completed.

The main feature of the control circuit is that the cooking program sequences stored in the storage station can be take out by actuation of any of keys of keyboard corresponding to the sequences. To this end, it is advantageous that the storage station of the microcomputer 9 preliminarily contain the cooking program sequences corresponding to a number of the kinds of cooking.

Otherwise, the respective cooking program sequence is entered to the storage station with the aid of numeral keys and function keys contained within the keyboard 10. Since such a programmable digital logic control circuit for storing the program information to a logic control circuit is described in detail in U.S. Pat. No. 4,011,428, a further description thereof is omitted.

Each of the cooking program sequences can be identified by each of the keys within the keyboard 10. Each of the cooking program sequences defined by one of the keys are taken out to control the combination cooking utensil 1.

Figure 4:
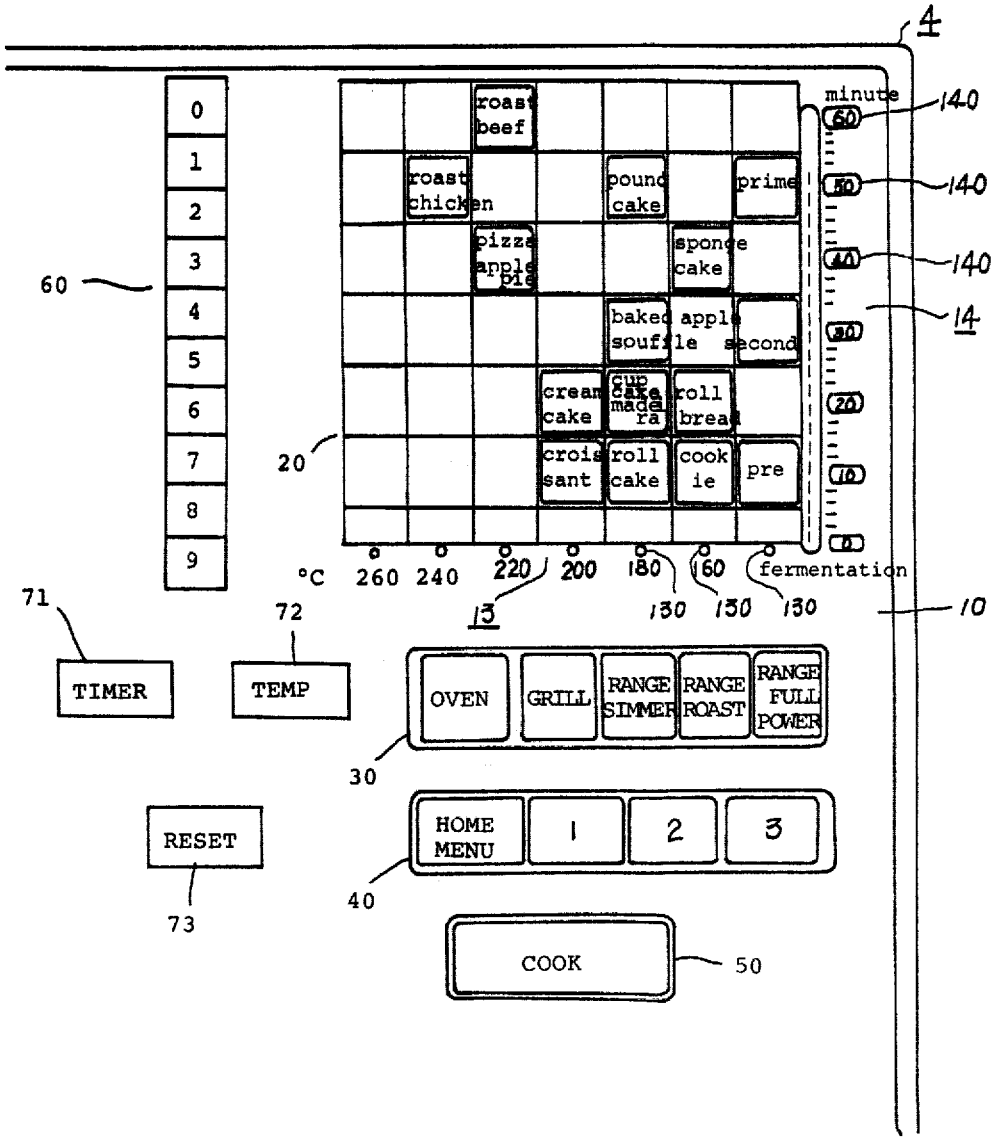
FIG. 4 is a front view of a control panel carried on the exterior of the combination oven of FIG. 1.

FIG. 4 shows a front view of the control panel 4 for indicating the scheme of the keyboard 10 in more detail.

The keyboard 10 is formed on the control panel 4. The keyboard 10 includes a matrix keyboard 20, a selective key unit 30, a home menu key unit 40, a cooking key 50, a digit key unit 60, a timer key 71, a temperature key 72, and a reset key 73.

The keyboard 10 is made of the well-known push button type key switch construction. In another case, it can be composed of a touch panel as disclosed in U.S. Pat. No. 4,011,428.

The matrix keyboard 20 includes a plurality of key tops on which the kinds of cooking are labeled for identification. Each of the keys contained within the matrix keyboard 20 is allocated such that it directs a cooking temperature in Centigrade defined by the abscissa and a cooking time period in minutes defined by the ordinate.

The abscissa of the matric keyboard 20 is equivalent to the temperature display 12 shown in FIG. 3 and contains a plurality of indicators 130 composed of, say, light emitting diodes. The ordinate, on the other hand, is equal to the time display 14 denoted in FIG. 3 and contains a number of indicators 140 made of, say, light emitting diodes.

The two series of the indicators 130 and 140 are illuminated in accordance with selection of any of the keys of the matrix keyboard 20.

Operation of the combination cooking utensil 1 is now described with the case where a key labeling "CREAM CAKE" is actuated for recalling the stored cooking program sequences for cream cake. The "CREAM CAKE" key is disposed at a cross point of 200° Centigrade and 20 minutes.

In response to the actuation of the "CREAM CAKE" key, its associated cooking program sequences are delivered from the microcomputer 9 to control the upper heater 5 and the lower heater 6. The actuation of the "CREAM CAKE" key enables the relevant indicators 130 and 140 to illuminate. Following the actuation of the "CREAM CAKE" key, the cooking key 50 is actuated to start the generated cooking program sequences for the cream cake, in which case any starting material for the cream cake is not disposed within the oven cavity 2.

In the above-stated cooking program sequences, a preliminary heating operation is conducted to heat the interior of the oven cavity 2 up to 200° Centigrade with the unloaded condition of the starting material for the cream cake. Upon the completion of the preliminary heating operation which is assured with the help of the thermistor 11, the buzzer 15 rings for announcement.

Then the door 3 is opened to place the starting material for the cream cake on the tray 8. While the door 3 is opened, the cooking program sequences are not advanced. If the starting material is disposed and then the door 3 is closed, the cooking program sequences are restarted in response to actuation of the cooking key 50. The following cooking program sequences are divided to the procedures of heating processes I and II. In the first heating process I, the interior of the oven cavity 2 is maintained at about 200° Centigrade for 15 minutes using the upper and the lower heaters 5 and 6. In the second heating process II, the oven cavity is kept at about 180° Centigrade for 5 minutes through the use of the heaters 5 and 6. The thermistor 11 allows the temperature control for the upper and the lower heaters 5 and 6 in the two heating processes I and II. The buzzer 15 indicates the completion of the two heating processes I and II.

Figure 5:
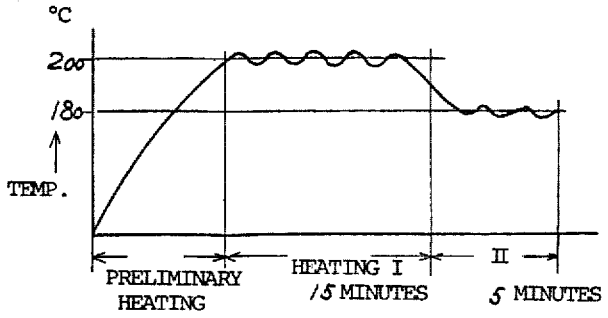
FIG. 5 is a graph showing a series of cooking program sequences related to particular cooking, say, cream cake.

FIG. 5 is a graph showing the cooking program sequences for the cream cake. As indicated in FIG. 5, there are programmed the preliminary heating operation, the first heating process I, and the second heating process II.

The other keys of the matrix keyboard 20 also correspond to the respective cooking program sequences depending upon the nature of the cooking to be performed. A further description of the other keys of the matrix keyboard 20 is omitted since this can be considered by ordinary skilled person in the art knowing the nature of the cooking.

A plurality of keys of the matrix keyboard 20 on which no kind of cooking is labeled also cause cooking program sequences related to any selective value of temperature values in the abscissa and cooking time periods in the ordinate. The cooking key 50 is also actuated in conjunction with the non-labeled keys. In such a case, the upper and the lower heaters 5 and 6 are ordinarily energized to perform the cooking program sequences containing temperature and cooking time information. The magnetron 7 may be further actuated to effect the same cooking program sequences, simultaneously.

In these cases, operation of the selective key unit 30 is not necessary. Otherwise, it is necessary for the keys of the selective key unit 30 to be actuated in relation with the keys contained within the matrix keyboard 20 as stated below.

Functions of the other keys in conjunction with the keys of the matrix keyboard 26 will be explained as follows according to a preferred example:

1. The selective key unit 30:

(1) An "OVEN" key is actuated to perform an oven mode in the combination cooking utensil 1. The order of instructions by actuation is: firstly the "OVEN" key within the selective key unit 30; secondary one of the keys contained within the matrix keyboard 20; lastly the cooking key 50. Thereby the interior of the oven cavity 2 is maintained at a selected temperature during a defined time period. The temperature value and the time period are identified by the actuated key of the matrix keyboard 20.

(2) A "GRILL" key is actuated to perform the well-known browner operation. The order of instructions by actuation in this case is: firstly the "GRILL" key; seconday one of the keys disposed in the matrix keyboard 20; lastly the cooking key 50. The actuated one of the matrix keyboard 20 instructs only time period information of the cooking program sequences, but not temperature information. The time period information can be introduced using the digit key unit 60 instead.

(3) Any of three range information keys, "RANGE FULL POWER", "RANGE ROAST", RANGE SIMMER", is actuated to conduct range modes. The "RANGE FULL POWER" key is designated to enable 100% power. The "RANGE ROAST" is 70% of the full power. The "RANGE SIMMER" is 50% of full power. The actuation sequence of the instructions is: firstly any of three range information keys; secondary any of the keys included within the matrix keyboard 20; finally the cooking key 50. The cooking temperature information and the time period information are selected with the actuated key of the matrix keyboard 20. The thermistor 11 should be utilized to detect the cooked temperature information. Needless to say, it is possible that the cooking temperature information may be placed in a constant irrespective of the keys of the matrix keyboard 20.

2. The home menu key unit 40:

The home menu key unit 40 is operated to freely store a plurality of desired cooking program sequences which are suitable for a specific family. The following actuation is carried out to store a set of the desired cooking program sequences: firstly a "HOME MENU" key; secondary one of three digit keys "1", "2" and "3" to identify one series of the desired cooking program sequences; lastly the digit key unit 60 in conjunction with the timer key 71 and the temperature key 72.

To read out and enable one series of the thus stored three cooking program sequences, the following operation should be effected: firstly the "HOME MENU" key; secondary one of the three digit keys "1", "2", and "3" to recognize the identity; lastly the cooking program key 50.

The reset key 73 is actuated for cancelling the introduced information.

While only certain embodiments of the present invention have been described, it will be apparent to those skilled in the art that various changes and modifications may be made therein without departing from the spirit and scope of the invention as claimed.

What is claimed is:

1. A control panel assembly for a cooking utensil having a keyboard operable to generate cooking program sequences for controlling energization of a heat source, the improvement comprising:

a plurality of the switches disposed within the keyboard and allocated in a matrix form where an abscissa represents temperature values and an ordinate represents time periods both of which provide information for the cooking program sequences, each of the plurality of key switches being provided for selecting the desired type of a specific resultant foodstuff and for reading out the associated cooking program sequences according to which the heat source is energized to cook the specific resultant foodstuff.

2. The control panel assembly according to claim 1, which further includes an indicator for showing at least one selected value of either of the temperature values and the time periods.

3. The control panel assembly according to claim 2, wherein the indicator comprises a light emitting diode (LED).

4. A cooking utensil including a heat source for cooking a foodstuff, said utensil comprising:

means for controlling the temperature of said foodstuff and period of energization of said heat source; and a matrix keyboard being formed of an M row x N column matrix array, M and N being integers greater than one, each of said M rows being representative of a different cooking duration and each of said N columns being representative of a different cooking temperature;

each key in said matrix being associated with unique cooking time and temperature combination data, the actuation of one of said keys enabling said means for controlling to utilize said keys associated data to control said heat source to thereby apply said unique cooking time and temperature to said foodstuff.

5. The utensil of claim 4, wherein said means for controlling includes storage means for containing said cooking time and temperature combination data, the actuation of one of said keys recalling its said associated data from its respective location in memory for use in controlling said heat source.

6. The cooking utensil according to claim 5, wherein said storage means is a read only memory (ROM).

7. The cooking utensil according to claim 4, wherein said keyboard is formed by a touch-actuative panel.

8. The cooking utensil according to claim 4, wherein the cooking utensil is a combination of a microwave oven and a different heating apparatus.

9. The cooking utensil of claim 4, further comprising digit and function key input means for programming time and energization data into said means for controlling independently of said matrix keyboard.

10. The cooking utensil of claim 9, wherein said digit and function key input means includes separate digit keys and function keys.

11. The cooking utensil according to claim 9, further comprising selection key means containing a plurality of key switches for directing the power utilization by said heat source.

12. The cooking utensil of claim 4, further comprising means for storing cooking program sequences generated by said keyboard means and digit and function key input means for recall and repetitive use.

13. The utensil of claim 4, wherein each key may be representative of the cooking temperature and duration necessary to correctly cook a specific foodstuff.

14. The utensil of claim 13, wherein each key may be labeled with the specific foodstuff correctly cooked by the temperature and duration represented by that key.

15. The utensil of claim 4, wherein each row has an associated indicia for indicating selection of a key in that row.

16. The utensil of claim 4, wherein each column has an associated indicia for indicating selection of a key in that column.

17. The utensil of claims 15 or 16, wherein said indicia are light-emitting diodes.

* * * * *